US005749756A

United States Patent [19]

Vockroth et al.

[11] Patent Number: 5,749,756

[45] Date of Patent: May 12, 1998

[54] SEALED CORROSION-PROOF CRIMPED TERMINAL OF SPLICE

[75] Inventors: William Joseph Vockroth, Harrisburg; James Donald Engle, Bainbridge; Ralph Richard Goss, Palmyra; Richard Dean Heim, Landisville; Ronald Joseph Maley, Landisville; David Keith Schrum, Hummelstown, all of Pa.

[73] Assignee: The Whitaker Corporation, Wilmington, Del.

[21] Appl. No.: 733,286

[22] Filed: Oct. 17, 1996

Related U.S. Application Data

[60] Provisional application No. 60/005,919, Oct. 27, 1995.

[51] Int. Cl.[6] ..... H01R 4/20

[52] U.S. Cl. ..... 439/879; 174/84 C

[58] Field of Search ..... 439/879, 882; 174/84 C

[56] References Cited

U.S. PATENT DOCUMENTS

| | | | |
|---|---|---|---|
| 2,316,267 | 4/1943 | McLam | 174/84 |
| 2,554,813 | 5/1951 | Buchanan | 439/879 |
| 2,724,098 | 11/1955 | Bergan | 339/276 |
| 2,748,367 | 5/1956 | Schelke et al. | 339/252 |
| 2,958,723 | 11/1960 | Logan et al. | 174/84 |
| 3,137,925 | 6/1964 | Wahl | 439/879 |
| 3,356,987 | 12/1967 | Gillespie | 339/223 |
| 3,955,044 | 5/1976 | Hoffman et al. | 174/84 C |
| 4,272,150 | 6/1981 | Fairbairn | 339/276 T |

FOREIGN PATENT DOCUMENTS

| | | |
|---|---|---|
| 975853 | 10/1975 | Canada . |
| 0 297 493 | 6/1988 | European Pat. Off. . |
| 0 521 190 | 7/1991 | European Pat. Off. . |
| 0 639 869 | 2/1995 | European Pat. Off. . |

*Primary Examiner*—Gary F. Paumen

*Attorney, Agent, or Firm*—Robert J. Kapalka; Anton P. Ness

[57] ABSTRACT

A crimped terminal (or splice) has a housing (10) including a barrel (11) receiving an insert sleeve (13). The barrel (11) has a lug (12) received in a complementary notch (14) formed in the insert sleeve (13), thereby circumferentially keying the insert sleeve (13) to the barrel (11), preventing relative rotation therebetween, and reinforcing the housing (10) during the crimping process. This eliminates cracking of the housing (10) during crimping while improving heat dissipation.

11 Claims, 9 Drawing Sheets

SEALED CORROSION-PROOF CRIMPED TERMINAL OF SPLICE

This application claims the benefit of U.S. Provisional Application Ser. No. 60/005,919, filed Oct. 27, 1995.

FIELD OF THE INVENTION

The present invention relates to a sealed corrosion-proof crimped terminal (or splice) for aluminum or copper wire, and more particularly, to a terminal (or splice) having a perforated insert sleeve for facilitating the crimping process and improving the product resulting therefrom.

BACKGROUND OF THE INVENTION

Sealed terminals and splices are a type of connector used especially for terminating discrete aluminum and copper lead wires. These connectors terminate stranded aluminum and copper wire using a "dry crimp" process which eliminates the need for an inhibitor agent to break down oxides which form on the aluminum and copper wire strands. The dry crimp technique results in a sealed connection, thereby preventing re-oxidation and corrosion after crimping.

A complete line of such high-quality copper sealed terminals and splices is supplied by AMP Incorporated of Harrisburg, Pa., U.S.A., under the registered trademark COPALUM®.

The prior art is also exemplified by U.S. Pat. No. 3,955,044 issued to Hoffman et al. on May 4, 1976 and assigned to AMP Incorporated, the assignee of the present invention.

U.S. Pat. No. 3,955,044 discloses an insert sleeve positioned within the barrel portion of the terminal, and the strands of wire (such as aluminum wire) are received within the insert sleeve. The insert sleeve is formed from a material which has a hardness equal to or greater than that of the wire. Moreover, the insert sleeve is a split cylindrical sleeve which is perforated. During the crimping process, the aluminum or copper wire extrudes through the perforations in the insert sleeve, thereby breaking down the aluminum or copper oxide film on the wire strands, increasing the surface contact areas, and facilitating good electrical contact with the terminal.

While perfectly satisfactory for the purposes intended, nevertheless, in some limited applications the insert sleeve may tend to rotate prior to crimping due to twisting of the wire and, as a result, this may cause cracking of the terminal during the crimping process.

SUMMARY OF THE INVENTION

Accordingly, it is an object of the present invention to improve upon the prior art and, more specifically, to substantially reduce (if not eliminate altogether) the occasional cracking of the terminal during the crimping process due to the tendency of the insert sleeve to rotate and become mislocated under certain circumstances.

The present invention finds particular utility in a crimped connector assembly (either for terminating an end of a wire or splicing the respective ends of two wires) wherein a housing has a hollow barrel provided with an open end, wherein an insert sleeve is received within the barrel, wherein the wire is received through the open end of the barrel and within the insert sleeve, and wherein the housing is crimped over the insert sleeve and the wire, thereby retaining the wire.

In accordance with the improvement of the present invention, a protruding lug is formed on the barrel, and the insert sleeve has a notch receiving the protruding lug on the barrel. As a result, the insert sleeve is circumferentially keyed to the barrel, thereby preventing relative rotation therebetween, improving heat dissipation, and reinforcing the housing and the insert sleeve when the housing is crimped over the insert sleeve and the wire.

Preferably, the housing has an interior wall adjacent to the hollow barrel, and the insert sleeve abuts against this interior wall. The lug protrudes axially from the interior wall of the housing, radially inwardly of the barrel, and in the direction of the open end thereof.

In a preferred embodiment, a tapered insertion ring is disposed within the barrel for guiding the wire therein, and the barrel has an internal annular indentation rearwardly of the tapered insertion ring and substantially adjacent thereto, thereby retaining the tapered insertion ring. Preferably, this tapered insertion ring is formed from a plastic material.

Additionally, an insertion funnel may be provided as an accessory to facilitate the insertion of the strands of wire (or wires) into the open end of the barrel portion of the housing.

These and other objects of the present invention will be apparent from a reading of the following specification taken in conjunction with the enclosed drawings.

GENERAL DESCRIPTION OF THE PREFERRED EMBODIMENT

Figure 1:
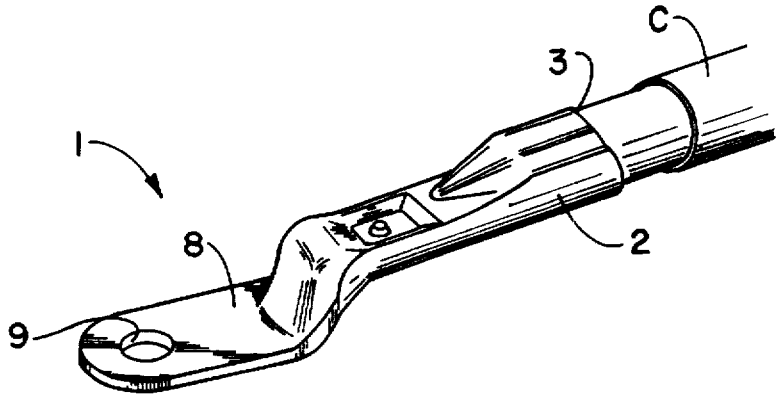
FIG. 1 PRIOR ART
FIG. 1 is a perspective view of a prior art terminal assembly shown fully assembled and crimped.
Figure 2:
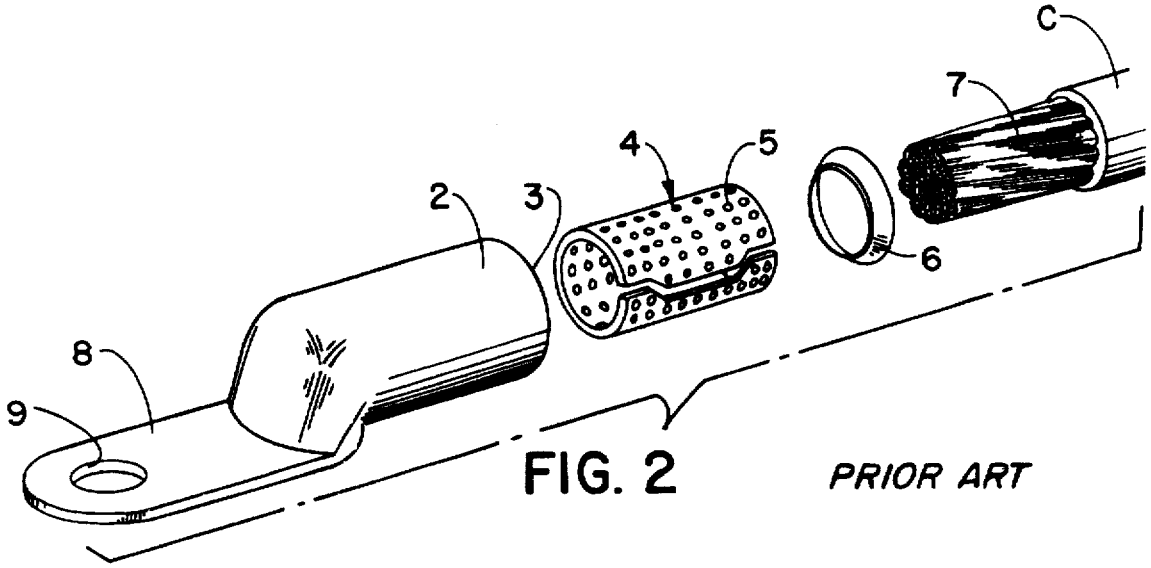
FIG. 2 PRIOR ART
FIG. 2 is a perspective view of the prior art terminal assembly of FIG. 1, showing the discrete components thereof in exploded relationship prior to the crimping operation.
Figure 3:
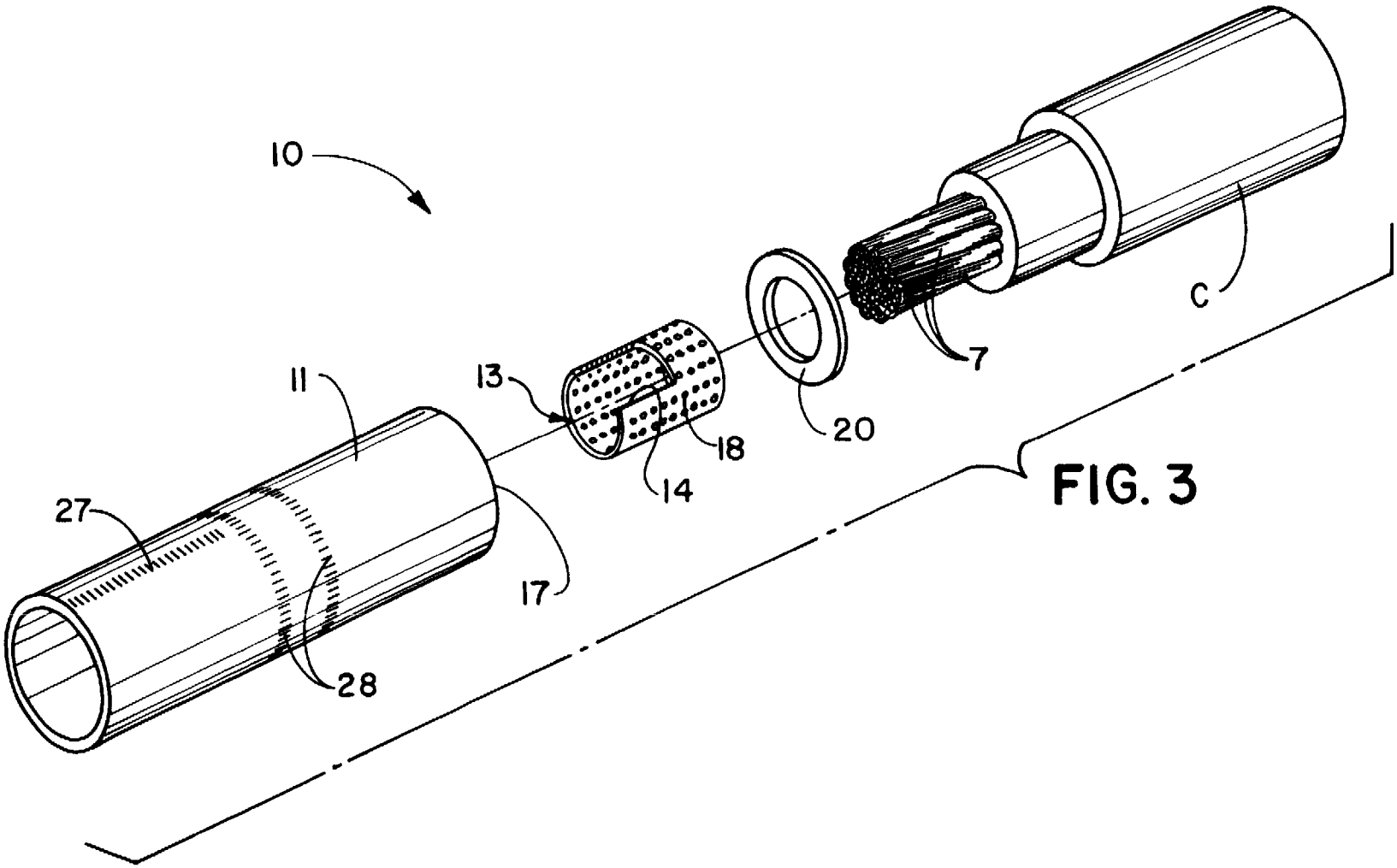
FIG. 3 is a further exploded perspective view, corresponding substantially to that of FIG. 2, but showing the improvement of the present invention.
Figure 4:
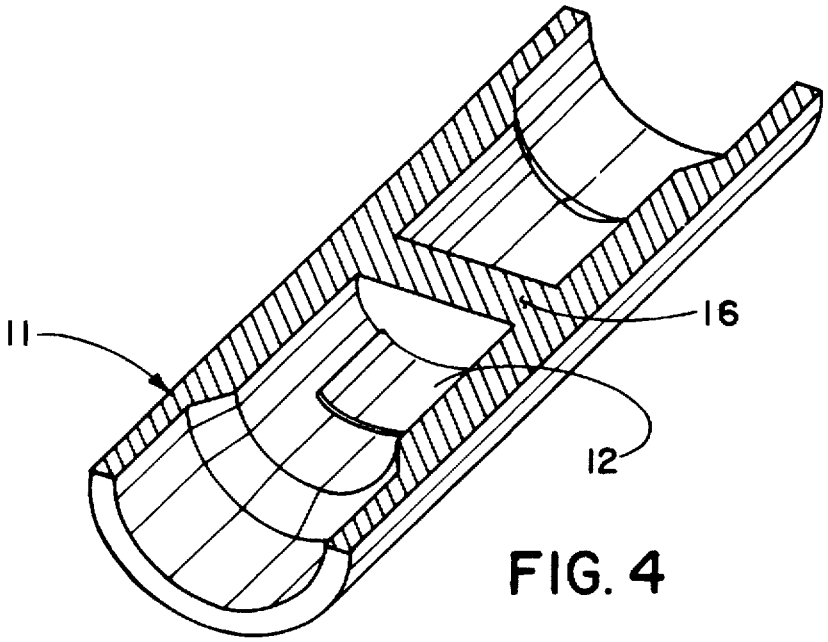
FIG. 4 is a bottom cut-away view of the splice housing used in the assembly of FIG. 3.

With reference to FIGS. 1–2, the prior art corrosion-proof sealed terminal 1 includes a hollow barrel 2 having an open end 3 for receiving an insert sleeve 4. The insert sleeve 4 is split and has a plurality of perforations 5. A tapered insertion ring 6 is received within the barrel 2, rearwardly of the insert sleeve 4, for facilitating insertion (or "lead in") of the wire strands 7 of a cable C. The terminal further has a flattened tongue 8 provided with an aperture 9 for mounting purposes. The terminal 1 is preferably made of solid copper but, if desired, may be made of aluminum and plated with copper, tin or silver. The cable C is provided with an insulation sheath impervious to moisture, and the insulation sheath may be covered by an abrasion-resistant sheath, if desired.

After assembly of these components, the terminal 1 is crimped, as shown in FIG. 1, to retain the wire strands 7. During the crimping process, the wire strands 7 tend to extrude through the perforations 5 in the insert sleeve 4, as described in the aforementioned '044 patent.

As will be appreciated, a splice between the respective stranded wires of two discrete cables may be made rather than terminating the stranded wires of a single cable (as in FIGS. 1 and 2). Thus, the terms "terminal" and "splice" may be used interchangeably consonant with the teachings of the present invention.

The improvement of the present invention is shown in FIGS. 3–9. There, a housing 10 has a barrel 11 provided with a protruding lug 12. The insert sleeve 13, in turn, has a notch 14 for receiving the lug 12 on the barrel 11, thereby circumferentially keying the insert sleeve 13 to the barrel 11 and preventing relative rotation therebetween. This structure assures that the proper "window" will be maintained at all times for the crimping process, thickening the wall section of the barrel 11, and reinforcing the housing 10 and the insert sleeve 13 at the crimp 15. Moreover, heat dissipation is improved.

Figure 5:
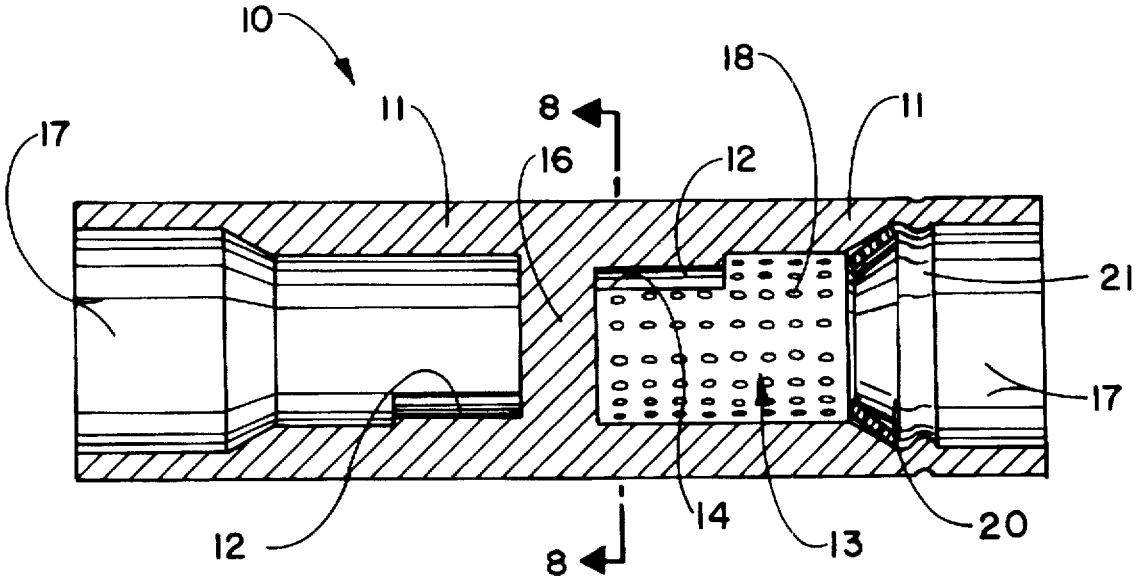
FIG. 5 is a longitudinal cross-sectional view of the splice assembly of FIG. 3 prior to the crimping process (the other insert sleeve being omitted for convenience of illustration).

As shown more clearly in FIG. 5, the housing 10 has an interior wall 16 separating the two barrels 11 (for splicing the respective wire strands of two discrete cables) and providing a water-tight gas-proof barrier. The insert sleeve 13 (only one of which is shown in FIG. 5) abuts against the interior wall 16, thereby limiting the insertion of the insert sleeve 13 into the barrel 11 of the housing 10. The lug 12 protrudes axially from the interior wall 16, radially inwardly of the barrel 11 of the housing 10, and in the direction of the open end 17 thereof.

Figure 9:
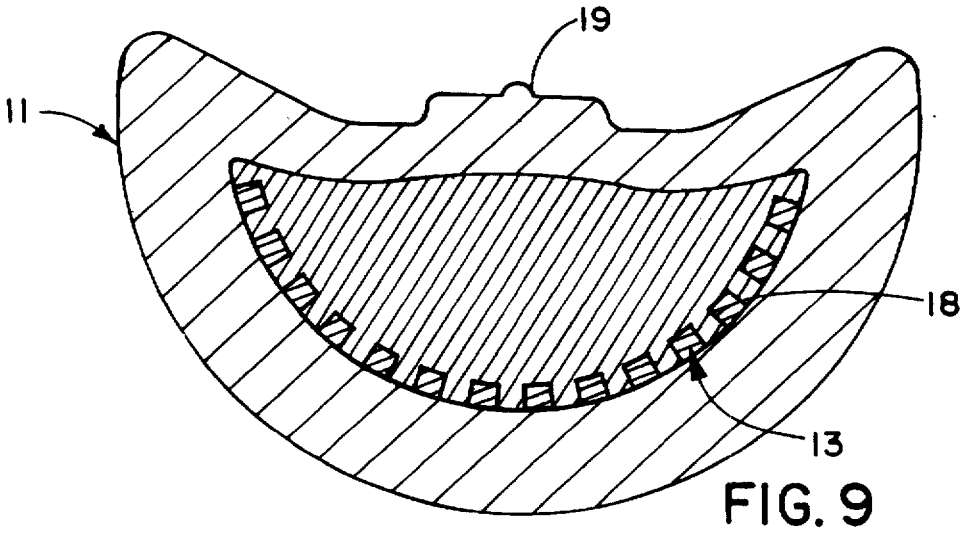
FIG. 9 is a further cross-sectional view, taken along the lines 9—9 of FIG. 6, corresponding substantially to FIG. 8, but showing the strands of wire received within the barrel portion of the housing, and further showing the housing crimped on the wire strands, such that the wire strands tend to extrude through the perforations formed in the insert sleeve, and compressing the wire strands into a complete homogeneous mass.

During the crimping process, the wire strands 7 tend to extrude through the perforations 18 in the insert sleeve 13, as shown more clearly in FIG. 9.

Figure 6:
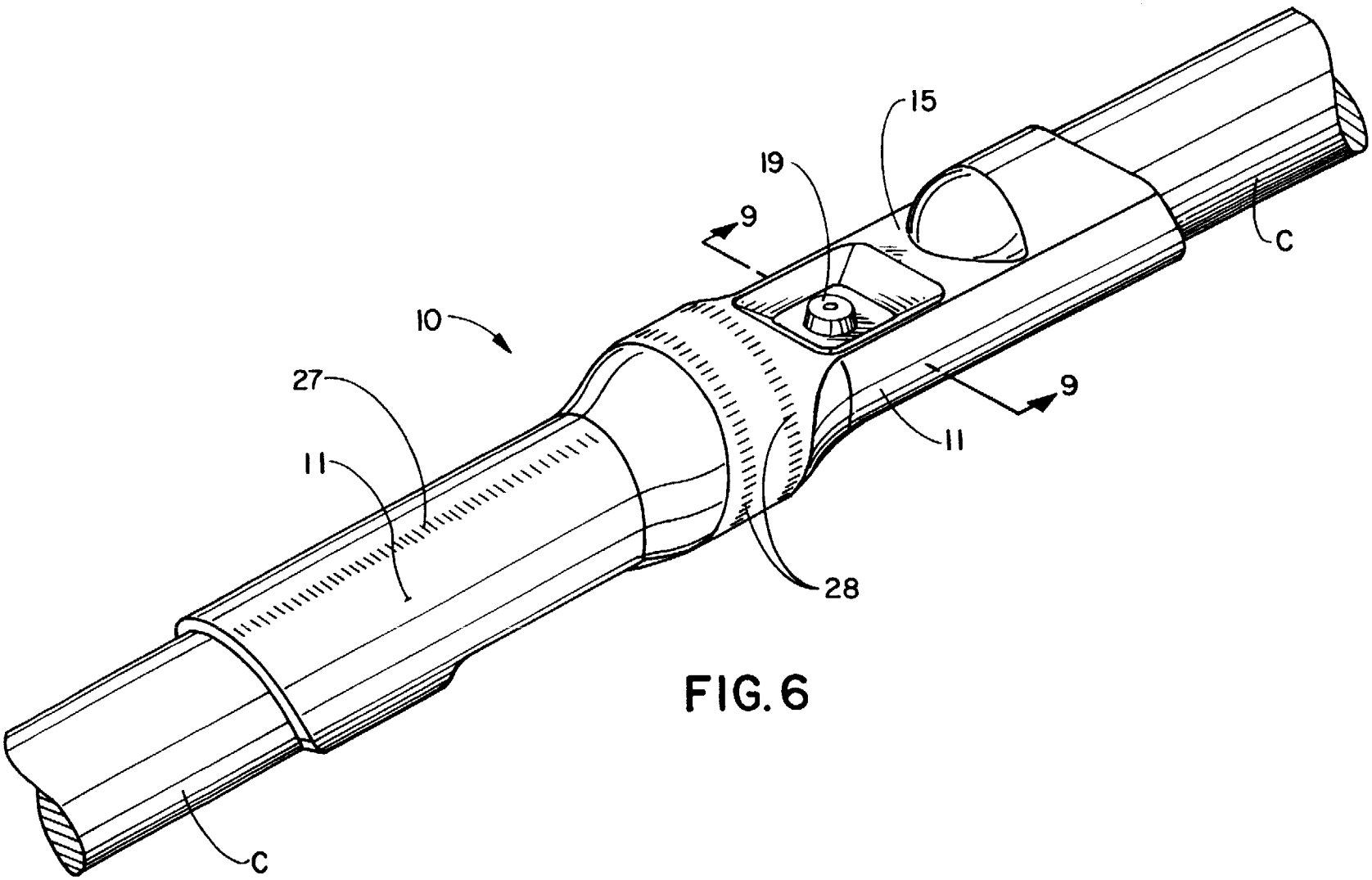
FIG. 6 is a perspective view of the improved crimped splice of FIGS. 3–5, thereby terminating the respective stranded wire of two cables.
Figure 7:
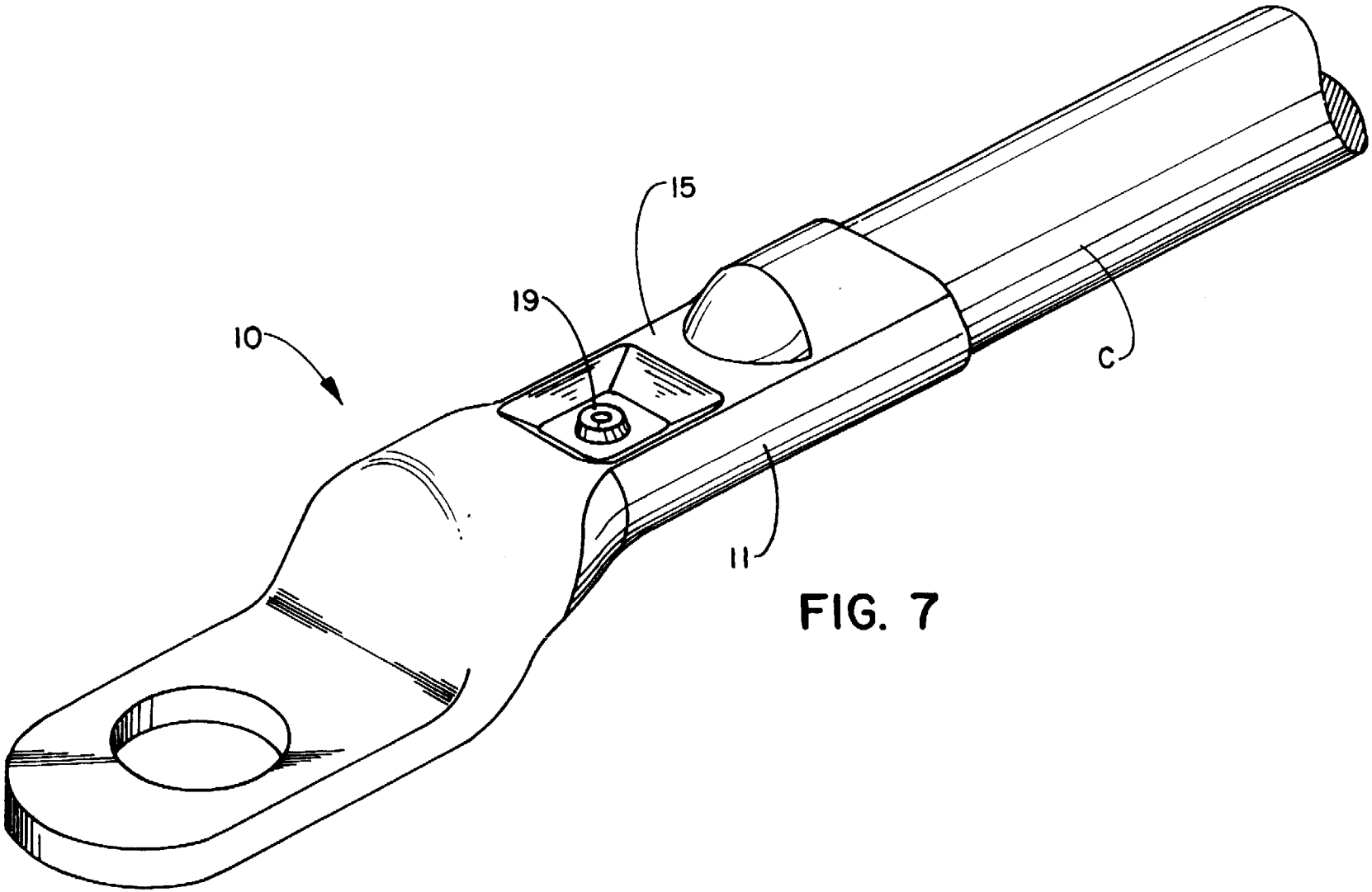
FIG. 7 is a further perspective view, corresponding substantially to FIG. 6, but showing that the teachings of the present inventions are equally applicable to a terminal for the stranded wires of a single cable.
Figure 8:
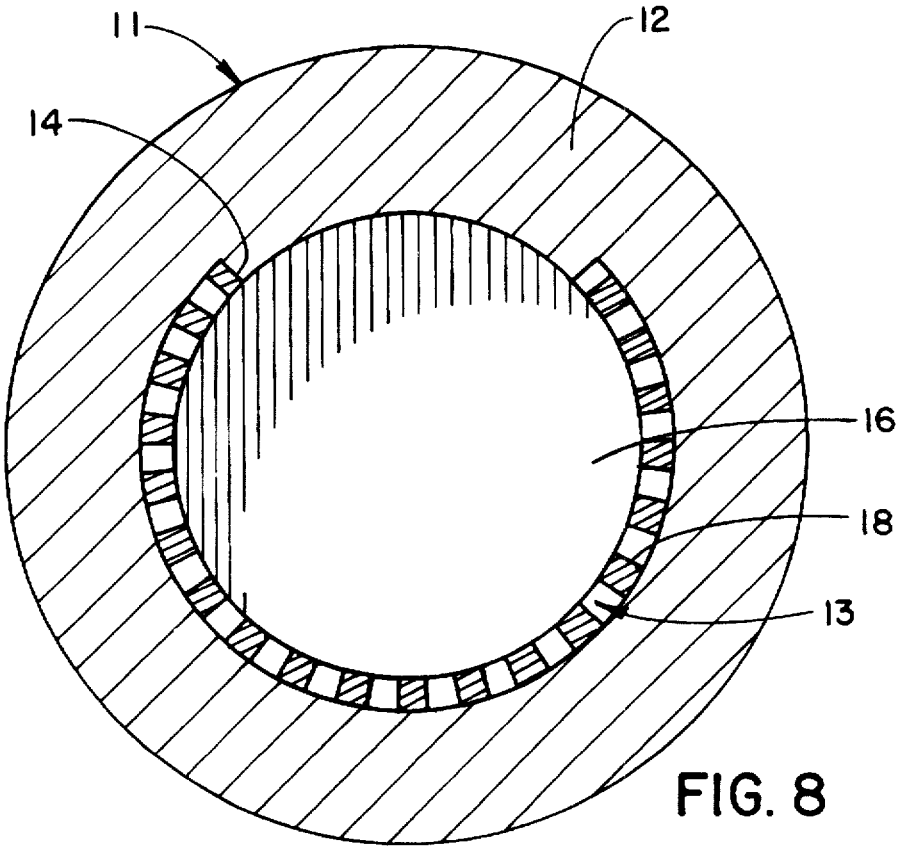
FIG. 8 is a cross-sectional view, taken along the lines 8—8 of FIG. 5, and showing the insert sleeve circumferentially keyed to the barrel portion of the housing.

The crimping operation is conventional and involves a pair of cooperating dies (not shown). Upon initiation of the crimp, the dies will initially engage against and indent into the barrel 11 of the housing 10. This radially compresses the barrel 11 as well as the insert sleeve 13 and the wire strands 7. When the crimping operation has been completed, a button 19 is formed at the top of the barrel 11 (as shown in FIG. 6, thereby indicating that a proper termination has been completed.

In the case of wire strands 7 made of aluminum or copper, the crimping operation causes the strands 7 to rub against each other; and this breaks down any existing aluminum or copper oxide layer. The result is a "cold weld" which establishes intimate interstrand contact. If desired, the crimped terminal 10 may then be encapsulated in protective heat-shrinkable tubing or the like (not shown).

Figure 10:
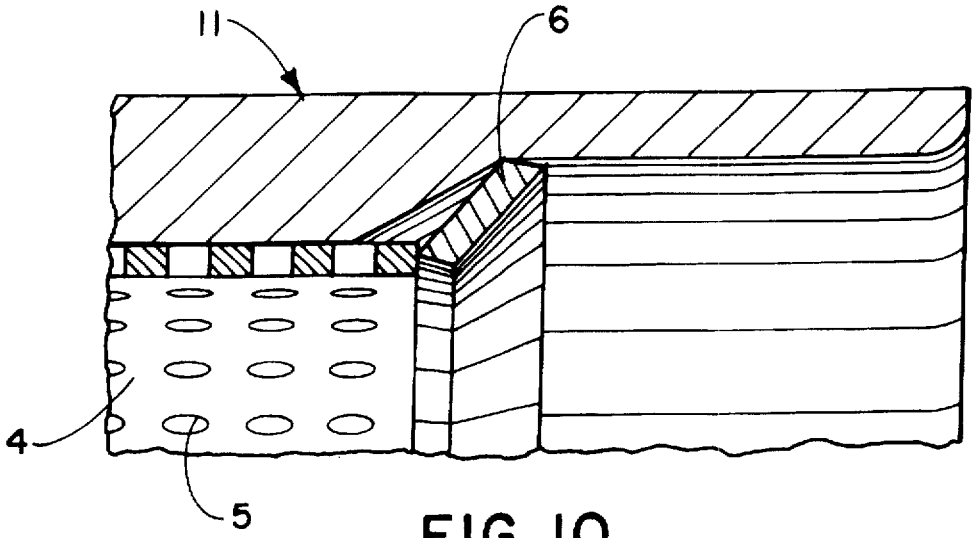
FIG. 10 is a partial longitudinal section of the housing showing a brass tapered insertion ring used in the prior art, which provides a steep (45°) angle of approach for the wire.
Figure 11:
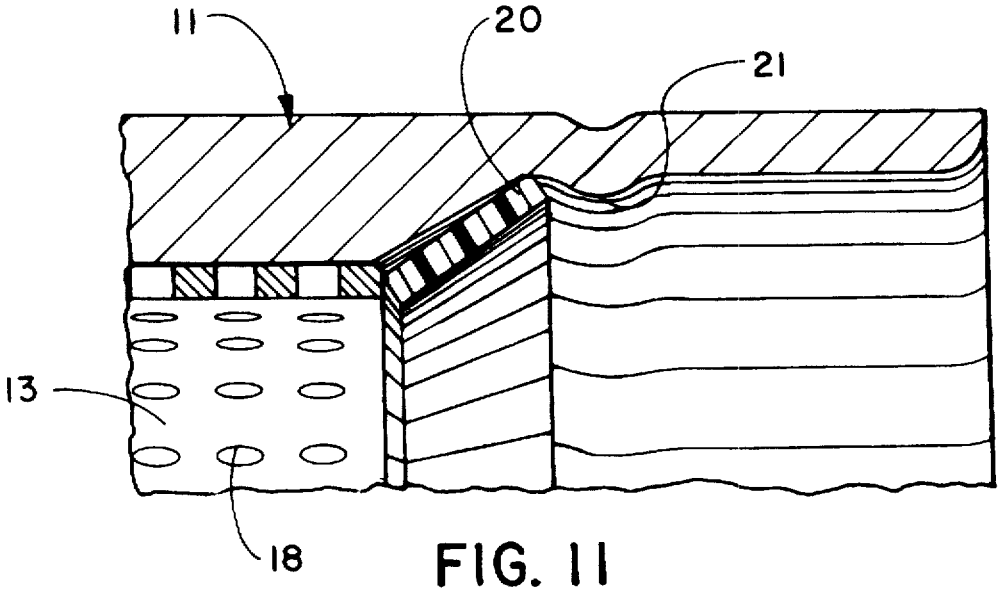
FIG. 11 is a further partial longitudinal section, corresponding substantially to that of FIG. 10, but showing a plastic tapered insertion ring retained by an internal annular indentation on the barrel in accordance with the further teachings of the present invention, thereby providing a slight angle of approach for the wire of approximately 30° for an improved function.

With reference to FIGS. 10 and 11, a plastic tapered insertion ring 20 (FIG. 11) has been substituted for the brass tapered insertion ring 6 of the prior art (FIGS. 2 and 10). The plastic tapered insertion ring 20 is within the barrel 11 (rearwardly of the insert sleeve 13) and is retained therein by an internal annular indentation 21 rearwardly of the plastic tapered insertion ring 20 and substantially adjacent thereto, thereby retaining the tapered insertion ring 20. The tapered insertion ring 20 guides the wire strands 7 into the insert sleeve 13 within the barrel 11 of the housing 10.

Figure 12:
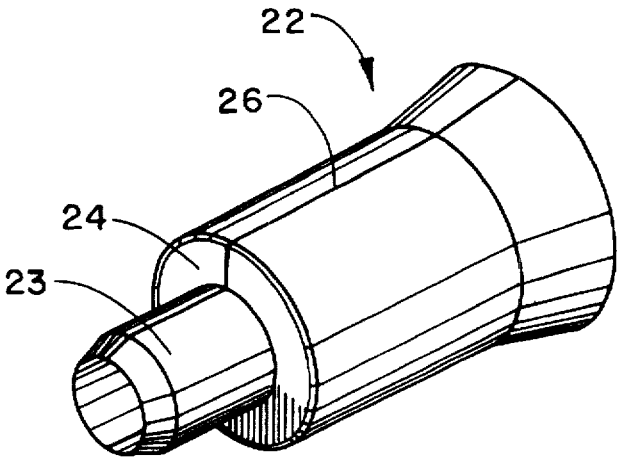
FIG. 12 is a perspective view of a funnel occasionally used as an accessory to facilitate the insertion of the strands of wire (or wires) into the barrel portion of the housing and, especially, inserting wires which have a natural flare due to their manufacture.
Figure 13:
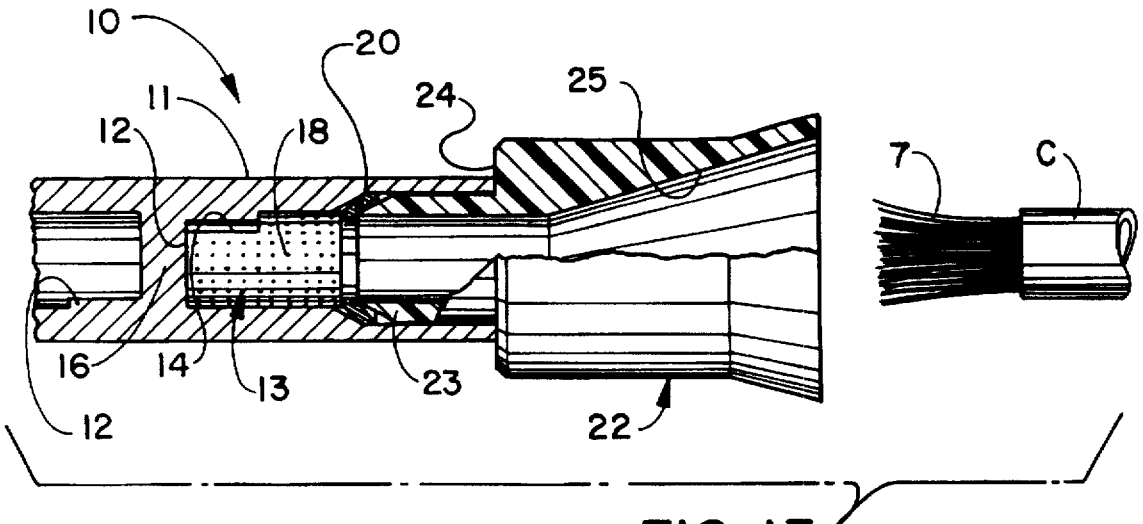
FIG. 13 is a longitudinal sectional view, corresponding substantially to FIG. 5, but showing the funnel of FIG. 12 inserted into the barrel of the housing, thereby facilitating insertion of the multiple strands of wire (or wires) into the barrel of the housing.

With reference to FIGS. 12 and 13, a reusable funnel 22 may be used as an accessory to the housing 10. The funnel 22 has a forward nipple 23 received within the barrel 11 of the housing 10. The insertion of the funnel 22 is limited by an annular shoulder 24 formed on the funnel 22 and abutting against the open end 17 of the barrel 11. The funnel 22 further has an internally tapered channel 25 (and flaring outwardly as shown in FIG. 13) for guiding the strands 7 of the wire (or wires). This prevents the individual wire strands 7 of the cable (or cables C) from becoming frayed inadvertently. After the wire strands 7 have been inserted, the funnel 22 is removed prior to the crimping operation.

This funnel 22 is a most valued accessory when inserting wires which have a natural flare due to their manufacture. Without this funnel 22, it is nearly impossible to get all of the wire bundles into the barrel 11.

The funnel 22 is formed by molding or the like from a resilient material, and the funnel 22 has a split 26 along at least one side thereof to allow detachment and removal from the wire 7 after complete wire insertion. If desired, the funnel 22 may be formed of two discrete mating pieces as, for example, molded hermaphroditic halves (not shown) which may be separated to allow removal from the wire 7 after crimping.

Figure 15:
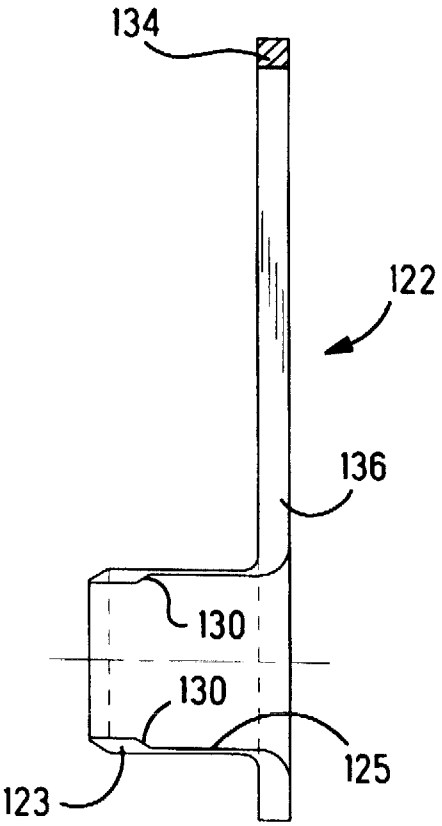
FIG. 15 is a partial cross sectional view of the funnel in FIG. 14.
Figure 14:
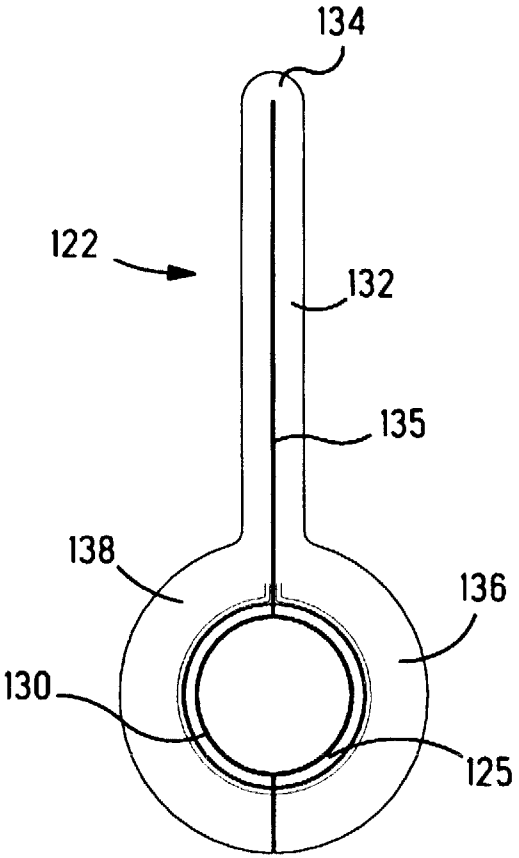
FIG. 14 is a top view of an alternative embodiment of the funnel.

Referring to FIGS. 14 and 15, another embodiment of the removable funnel is shown. The funnel 122 operates in the same manner as funnel 22. The funnel 122 has a forward stepped portion 123 which is received into the opening of the barrel. The funnel has a channel 125 through which wires can be directed into the barrel and which has a stepped portion 130 which is along the same end as the forward stepped portion 123. The funnel 122 also has a handle 132 which extends outwardly from the main portion of the funnel. The user can grasp the handle and insert the forward stepped portion 123 into the end of the barrel 11. The funnel 122 can then serve to guide wires into the barrel 11.

The funnel is made from two halves 136, 138 which are connected together by a hinge 134. A slot 135 separates the two halves and the hinge 134 is at an outwardly end of the handle 132. After the funnel is used to help insert wires into the barrel 11, the two halves 136, 138 can be pulled away from each other so that the funnel 122 can be removed from the wire, but the two halves will still be attached to each other so that the funnel 122 can be reused to insert another wire into another barrel 11. After pulling the two halves apart and removing the funnel from the wires, the two halves will then spring back together so that the funnel can be reused.

Referring again to FIG. 3, along the exterior of the barrel 11 is provided with a longitudinal knurled stripe 27 for alignment purposes, as well as a pair of spaced-apart annular knurled bands 28 for crimp depth location.

Obviously, many modifications may be made without departing from the basic spirit of the present invention. Accordingly, it will be appreciated by those skilled in the art that within the scope of the appended claims, the invention may be practiced other than has been specifically described herein.

We claim:

1. A crimped assembly for terminating an end of a wire, the assembly having a housing, the housing having a hollow barrel provided with an insert sleeve which is received within the barrel and abuts against an interior wall thereon, wherein the wire is received through the open end of the barrel and within the insert sleeve, and wherein the housing is crimped over the insert sleeve and the wire, thereby retaining the wire; a protruding lug on the barrel, the protruding lug extends axially from the interior wall, radially inwardly of the barrel, and in the direction toward the open end thereof, and the insert sleeve having a notch receiving the protruding lug on the barrel, thereby circumferentially keying the insert sleeve to the barrel and preventing relative rotation therebetween, improving heat dissipation, and reinforcing the housing and the insert sleeve when the housing is crimped over the insert sleeve and the wire.

2. The assembly of claim 1, further including a tapered insertion ring within the barrel for guiding the wire therein, and the barrel having an internal indentation rearwardly of the tapered insertion ring and substantially adjacent thereto, thereby retaining the tapered insertion ring in the barrel.

3. The assembly of claim 2, wherein the tapered insertion ring is formed from a plastic material.

4. The assembly of claim 1, wherein the insert sleeve is perforated.

5. The assembly of claim 1, wherein the crimped assembly comprises a terminal for a single wire.

6. The assembly of claim 1, wherein the crimped assembly comprises a splice between respective wires.

7. The assembly of claim 1, wherein the wire has a plurality of strands, and wherein a removable funnel is inserted through the open end of the barrel of the housing, thereby facilitating insertion of the wire strands into the barrel.

8. The assembly of claim 7, wherein the funnel has a forward nipple received in the barrel.

9. The assembly of claim 8, wherein the funnel is split longitudinally to facilitate removal of the funnel following insertion of the wire into the barrel and prior to the crimping operation.

10. A crimped assembly for terminating an end of a wire, the assembly having a housing comprising a hollow barrel provided with an open end, wherein an insert sleeve is received within the barrel, wherein the wire is received through the open end of the barrel and within the insert sleeve, and wherein the housing is crimped over the insert sleeve and the wire, thereby retaining the wire, a tapered insertion ring is provided within the barrel for guiding the wire therein, the barrel having an internal annular indentation rearwardly of the tapered insertion ring and substantially adjacent thereto, thereby retaining the tapered insertion ring, a protruding lug is provided on the barrel, the insert sleeve having a notch receiving the protruding lug on the barrel, the cooperation of the protruding lug on the notch circumferentially keying the insert sleeve to the barrel and preventing relative rotation therebetween, improving heat dissipation, and reinforcing the housing and the insert sleeve when the housing is crimped over the insert sleeve and the wire.

11. A crimped assembly for terminating an end of a wire having a plurality of strands, the assembly having a housing comprising a hollow barrel provided with an open end, wherein an insert sleeve is received within the barrel, wherein the wire is received through the open end of the barrel and within the insert sleeve, and wherein the housing is crimped over the insert sleeve and the wire, thereby retaining the wire, a removable funnel is inserted through the open end of the barrel, to facilitate insertion of the wire strands into the barrel, a protruding lug is provided on the barrel, the insert sleeve having a notch receiving the protruding lug on the barrel, thereby circumferentially keying the insert sleeve to the barrel and preventing relative rotation therebetween, improving heat dissipation, and reinforcing the housing and the insert sleeve when the housing is crimped over the insert sleeve and the wire.

* * * * *

UNITED STATES PATENT AND TRADEMARK OFFICE

CERTIFICATE OF CORRECTION

PATENT NO. : 5,749,756

DATED : May 12, 1998

INVENTOR(S) : William J. Vockroth, James D. Engle, Ralph R. Goss, Richard D. Heim, Ronald J. Maley, David K. Schrum, Brian Robert Schleinkofer It is certified that error appears in the above-identified patent and that said Letters Patent is hereby corrected as shown below: Title page, Item [75], "Add the name of co-inventor
Brian Robert SchleinKofer"

Signed and Sealed this

Twenty-eighth Day of July, 1998

*Attest:*

Bruce Lehman

BRUCE LEHMAN

*Attesting Officer*

*Commissioner of Patents and Trademarks*